US012050071B2

(12) United States Patent
Brusseau

(10) Patent No.: US 12,050,071 B2
(45) Date of Patent: Jul. 30, 2024

(54) RIFLE AND HANDHELD GUN MAGAZINE ACCESSORY FOR SECURITY

(71) Applicant: Michael John Brusseau, Center City, MN (US)

(72) Inventor: Michael John Brusseau, Center City, MN (US)

( * ) Notice: Subject to any disclaimer, the term of this patent is extended or adjusted under 35 U.S.C. 154(b) by 169 days.

(21) Appl. No.: 17/142,441

(22) Filed: Jan. 6, 2021

(65) Prior Publication Data

US 2021/0262748 A1 Aug. 26, 2021

Related U.S. Application Data

(60) Provisional application No. 62/958,684, filed on Jan. 8, 2020.

(51) Int. Cl.
*F41A 17/44* (2006.01)
*F41A 17/04* (2006.01)
*F41A 17/06* (2006.01)

(52) U.S. Cl.
CPC ..... *F41A 17/44* (2013.01); *F41A 17/04* (2013.01); *F41A 17/063* (2013.01); *F41A 17/066* (2013.01)

(58) Field of Classification Search
CPC ..... F41A 17/44; F41A 17/04; F41A 17/063; F41A 17/066; F41A 9/65
See application file for complete search history.

(56) References Cited

U.S. PATENT DOCUMENTS 4,384,420 A * 5/1983 Von Muller ..... F41A 17/44 42/70.11
4,528,765 A * 7/1985 Johnson ..... F41A 17/44 42/70.05
4,532,729 A * 8/1985 Von Muller ..... F41A 17/44 42/70.11
4,619,062 A * 10/1986 Johnson ..... F41A 17/42 42/49.02
5,671,560 A * 9/1997 Meller ..... F41A 17/02 42/66
5,782,029 A * 7/1998 Brooks ..... F41A 17/02 42/70.11
6,256,919 B1 * 7/2001 Brazeau ..... F41A 17/44 42/70.04
6,256,920 B1 * 7/2001 Olson ..... F41A 17/44 42/70.02
6,357,156 B1 * 3/2002 Klebes ..... F41A 17/066 42/70.01
6,412,207 B1 * 7/2002 Crye ..... F41A 17/02 42/70.01
7,543,403 B1 * 6/2009 Schaefer ..... F41A 17/02 42/70.02

(Continued)

*Primary Examiner* — Joshua E Freeman
(74) *Attorney, Agent, or Firm* — Jose W. Jimenez; JIMENEZ LAW FIRM

(57) ABSTRACT

Described herein is a physical interlocking rifle or gun magazine that temporarily incapacitates the weapon but allows the owner to quickly remove the safety magazine and insert a usable magazine with live ammunition to respond to an emergency situation. In one example embodiment, the safety magazine includes a biometric actuator that identifies an authorized user of the weapon and immediately disengages that interlocking mechanism in the safety magazine to allow its prompt removal and replacement with an operative magazine.

10 Claims, 3 Drawing Sheets

(56) References Cited

U.S. PATENT DOCUMENTS

| | | | | |
|---|---|---|---|---|
| 7,568,302 | B1 * | 8/2009 | Bubits | F41A 17/56 42/70.01 |
| 10,422,601 | B2 * | 9/2019 | Harris | F41A 9/65 |
| 10,914,542 | B2 * | 2/2021 | Biran | F41A 17/38 |
| 10,914,543 | B2 * | 2/2021 | Dulude | F41A 17/42 |
| 2006/0080881 | A1 * | 4/2006 | Cuprin | F41A 17/066 42/70.02 |
| 2018/0023911 | A1 * | 1/2018 | Harris | F41A 9/65 42/70.02 |
| 2018/0128570 | A1 * | 5/2018 | Sawicki | F41A 9/65 |

* cited by examiner

"UNLOCKED" POSITION
"LOCKED" POSITION
100
110
112
116
114
118
AR-15
150

BOLT BLOCK
136B
136A
MAGAZINE WELL INTERLOCK CAMS (2X)
AR-15
"TEACH" BUTTON ACCESS
180

150
160
BIOMETRIC READER

RIFLE AND HANDHELD GUN MAGAZINE ACCESSORY FOR SECURITY

CLAIM OF PRIORITY

This application claims priority to and the benefit of U.S. Provisional application with Ser. No. 62/958,684 filed on Jan. 8, 2020, with the same title as this application, which is hereby incorporated by reference in its entirety.

FIELD OF THE INVENTION

The invention relates generally to a magazine accessory for rifle and gun security.

BACKGROUND

Currently there are rifle and gun accessories, such as trigger locks, which are available for enhanced security for gun or rifle owners. In some cases, weapons are kept in a safe in a home for increased security to ensure, weapons are not improperly accessed by younger members of the home either for innocent or malicious purposes. Although these security approaches are effective, real life circumstances sometime require immediate access to the gun or rifle by the owner due to an intruder that suddenly appears and threatens to unlawfully enter your home, or a situation turns violent at your home or workplace requiring you to at least meet the threat head on and immediately. The above solutions would be ineffective to stop any threat on a timely basis. Therefore, there is a need in the market for a gun or rifle magazine accessory that provides effective short term security against improper access or use of an owner's gun or rifle while allowing for quick access to an operative gun or rifle when the situation or emergency calls for it.

SUMMARY OF THE INVENTION

There is described a smart gun or rifle magazine accessory or device that provides a physical barrier and visual signal that a gun or rifle is in a safe and unusable state. The inventive concepts described herein include a physical interlocking rifle or gun magazine that temporarily incapacitates the weapon but allows the owner to quickly remove the safety magazine and insert a usable magazine with live ammunition to respond to an emergency situation. In one example embodiment, the safety magazine includes a biometric actuator that identifies an authorized user of the weapon and immediately disengages that interlocking mechanism in the safety magazine to allow its prompt removal and replacement with an operative magazine. In a related embodiment, the control circuit of the magazine accessory includes an alarm triggered by attempted destruction of the device, the alarm adapted to either produce extremely loud noise or a spray of indelible ink sprayed onto a person attempting to destroy or remove the magazine accessory without authorization.

In another embodiment, a smart weapon magazine accessory includes a Bluetooth™ sensor or RFID sensor that is responsive to an authorized user's corresponding device for opening the safety magazine. In yet another related embodiment, the sensor in the safety magazine is responsive to a smart device or smartphone applet to allow for its prompt disabling of the interlocking mechanism and use of a loaded magazine. In another related embodiment, the interlocking mechanism for the safety magazine remains unchanged but a combination lock is included on the outside of the magazine that releases the internal interlocking mechanism and allows for quick removal of the safety magazine. The safety magazine can be brightly colored to provide a visual signal that the weapon is "locked" and does not include live ammunition, thereby allowing law enforcement authorities to deescalate a dangerous situation without fear of the weapon intentionally or negligently being fired or used.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Following are more detailed descriptions of various related concepts related to, and embodiments of, methods and apparatus according to the disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

The various embodiments of the invention provide for rifle or gun magazine accessory devices that incapacitate the rifle and allows for quick access and use by an authorized user should an emergency arise.

Figures 1A, 1B, 1C:
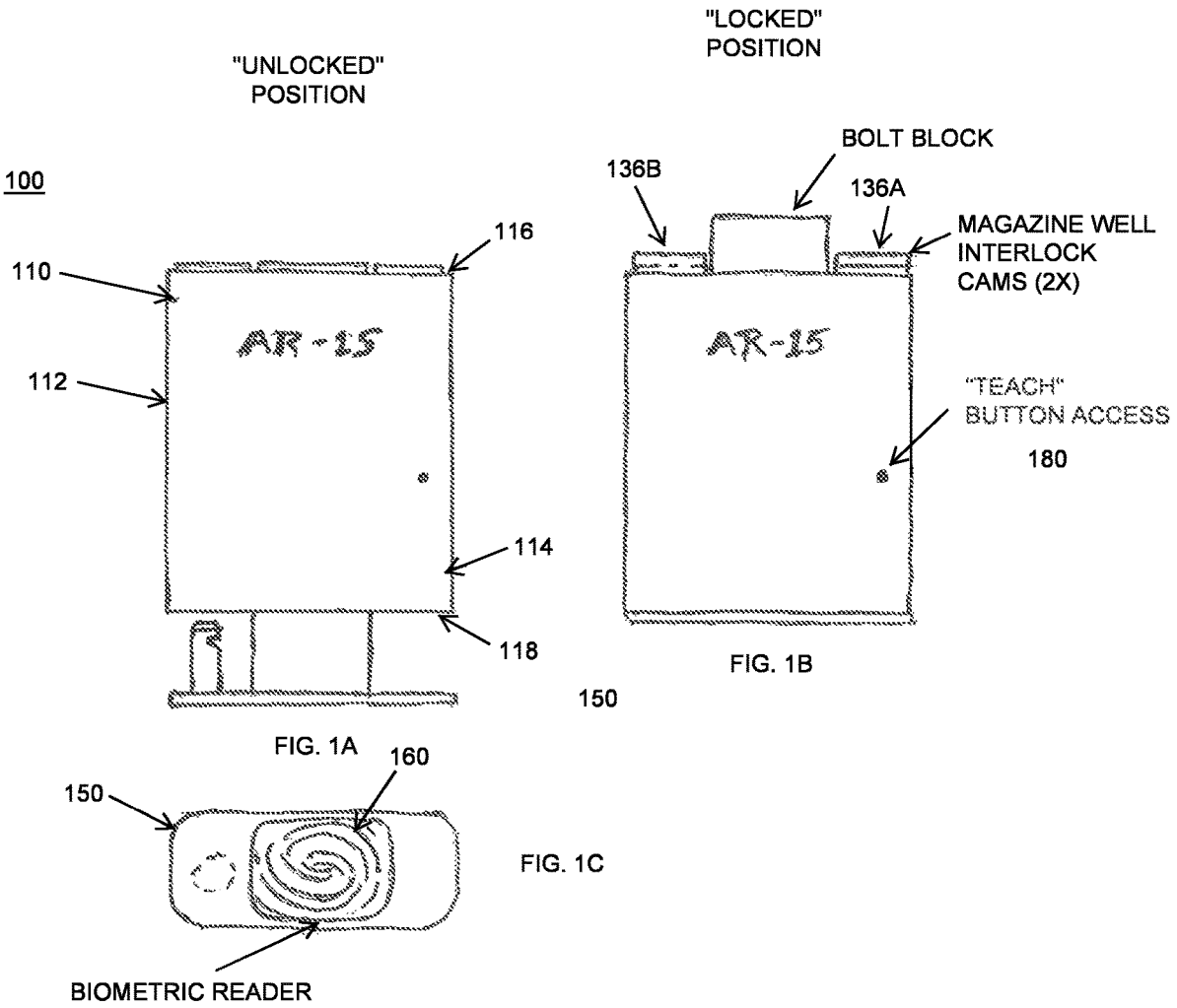
FIGS. 1A-1C illustrate front and bottom views, respectively, of an unlocked and locked safety gun or rifle magazine accessory with an interlocking mechanism for increased security of an accessible weapon.

Referring to the figures, FIGS. 1A-1C illustrate an exterior of a smart rifle magazine device accessory 100 for placement in a rifle or gun for enhanced security and safety. Smart rifle magazine device accessory 100 includes a rectangular housing member 110 having an inner surface 112, an outer surface 114, a top opening 116 and a bottom opening 119, the housing member 110 having an internal plate 117 in contact with the inner surface 112 and having a horizontal orientation parallel to the top opening 116. In this example embodiment, FIG. 1C illustrates a base plate 150 with an integrated biometric reader 160 integrated therein and electrically or electromechanically coupled to an interlocking mechanism 130 located within the housing member 110. FIG. 1B also illustrates a teach button or switch 180 on housing member 110 for programming the interlocking mechanism to align or respond to a particular user.

Figure 2:
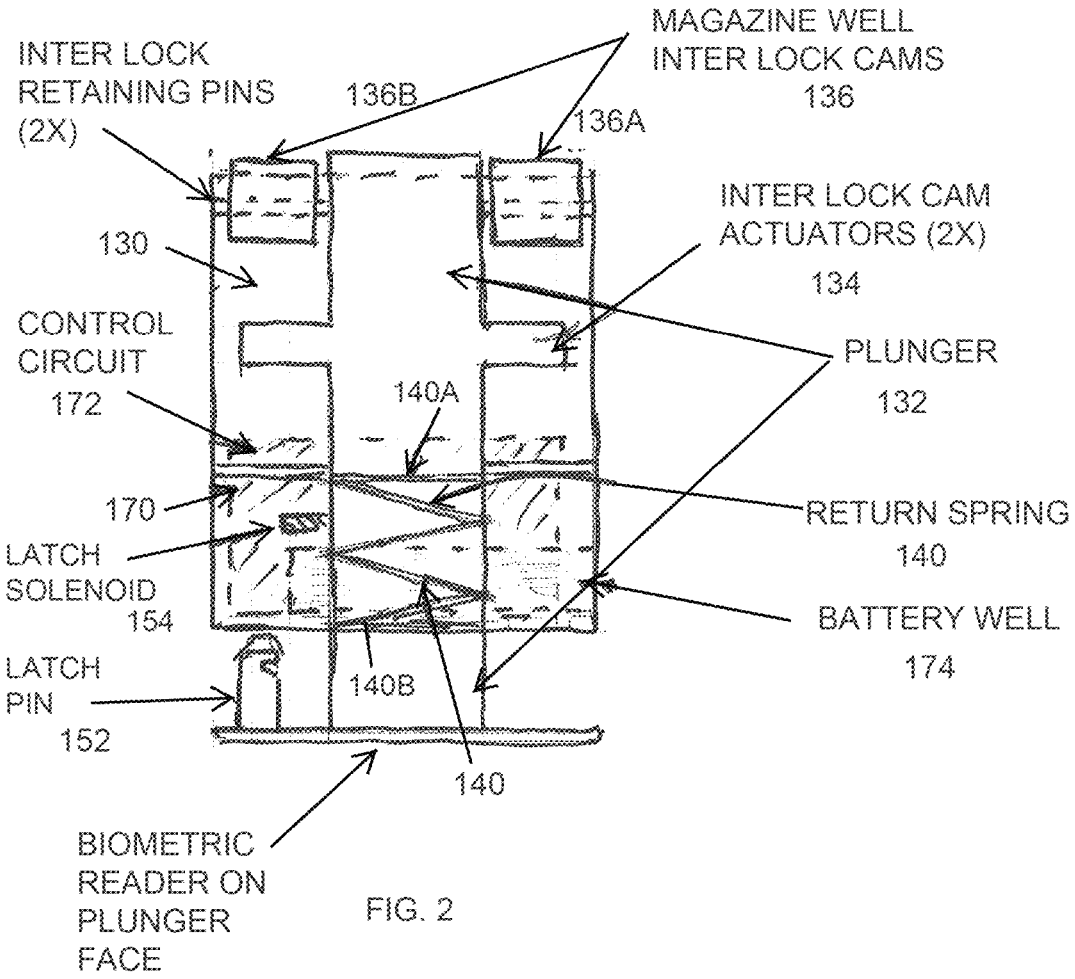
FIG. 2 illustrates a front internal view of the safety gun magazine exhibiting the internal components of the interlocking mechanism.

In this example embodiment and referring also to FIG. 2, the rifle magazine accessory 100 includes an interlocking mechanism 130 located within the housing member 110 including a center post or plunger member 132 designed to pass through an aperture 119 of the internal plate 117 and protrude from the top opening 116 of the housing member 110 upon actuation to block a bullet chamber of a rifle or gun. Interlocking mechanism 130 further includes a circular spring member 140 disposed about the center post member 132 and bounded by the internal plate 117 at a distal end 140A of the spring member and at a proximal end 140B of the spring member 140 by a laterally protruding tab(s) 134 on center post 132. Circular spring member 140 is designed to provide an expanding force against the protruding tab(s) 134 when the center post 132 protrudes from the top opening 116 when the lock is actuated.

In this example embodiment, and as referenced above rifle magazine accessory 100 further includes base plate 150 that is coupled to and supports the center post member 132 in a sliding relationship within the circular spring member 140 and is designed to close the bottom opening 118 of housing 110. The base plate 150 includes a latch pin 152 designed to engage a retractable latch plate 154 located within the housing member 110, the latch plate 154 being actuated by a locking mechanism located within the housing 110 below the internal plate 117.

In this and in related embodiments, the latch plate 154 is actuated by any one of a solenoid latch plate circuit 170 including a control circuit 172 and a power source such as a battery located within a battery well 174, with control latch plate circuit 170 designed to be dislodge plate 154 with a biometric signal or an RF signal from a smart device. In a related embodiment, latch plate 154 is dislodged from latch pin 152 with a combination lock designed to mechanically or electromechanically dislodge the latch plate 154 from latch pin 152. As stated above teach button 180 is electrically coupled to control circuit 170 and to reader 160 to set up the authentication or identification procedure.

In this example embodiment, the interlocking mechanism 130 includes at least one interlocking cam 136A located at or near the top opening 116 designed to engage a portion of the bullet chamber of the rifle (not shown) when actuated. Center post 132 further includes at least one laterally protruding tab 134 located vertically below the one interlocking cam 136A and is designed to contact and engage the one interlocking cam 136A upon moving the center post member 132 upwards towards the top opening 116.

Figure 3A:
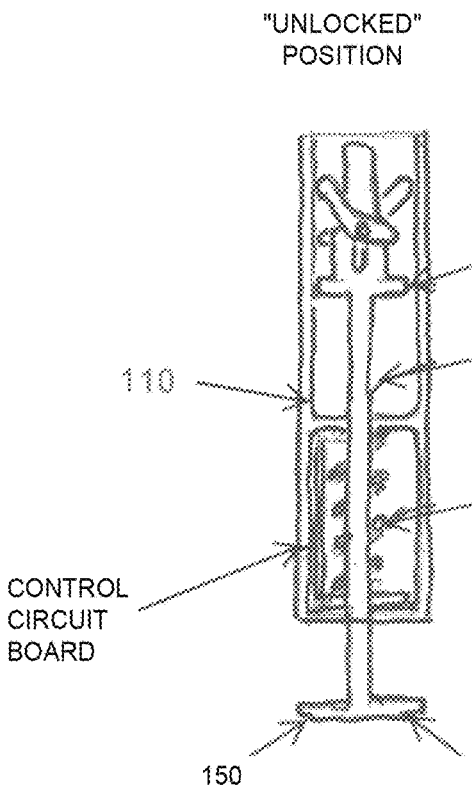
FIGS. 3A and 3B illustrate side views of an unlocked and locked, respectively, of the safety gun or rifle magazine accessory with the interlocking mechanism responsive to a biometric or other safety/identification access device for increased security of an accessible weapon.
Figure 3B:
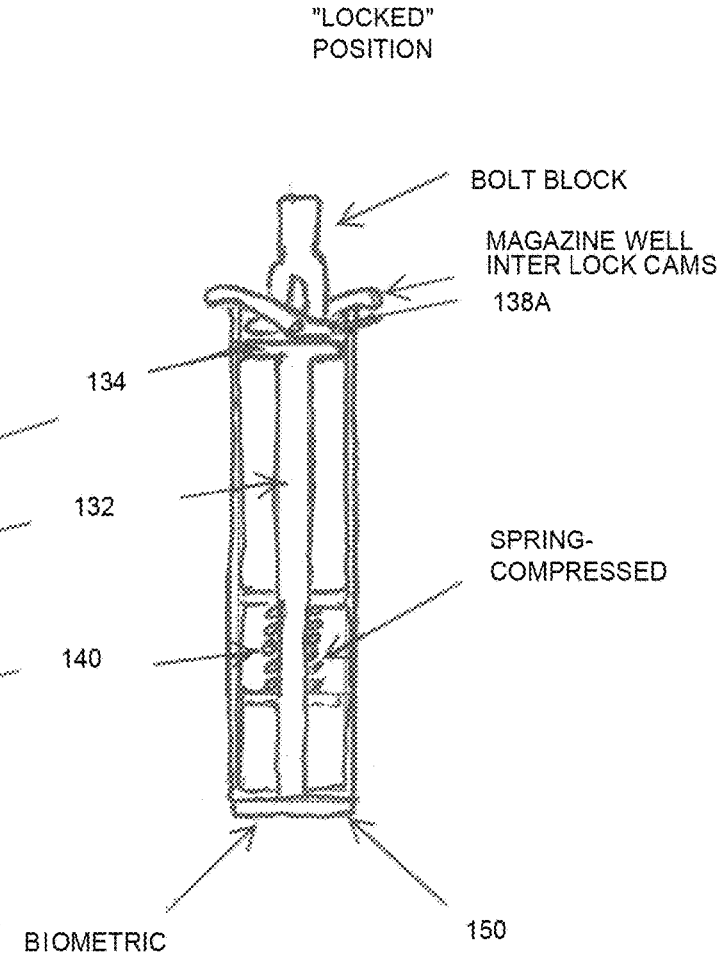

Referring now to FIGS. 3A and 3B and in this example embodiment, the interlocking cam 136A includes at least two cantilevering members 138A and 138B designed to open and extend laterally out from the top opening 116 upon center post 132 moving up (see arrow) and cam 136A being actuated by the laterally protruding tab 134 of the center post member 132. Cantilevering members 138A and 138B are designed to close and fold inwardly into the housing member 110 when the center post member 132 is retracted down (see arrow) into housing 110. In this example embodiment, magazine accessory 100 the interlocking mechanism 130 includes a second interlocking cam 136B disposed on a side of the center post 132 and the housing 110 opposite the first interlocking cam 136A.

In a related embodiment, the housing 110 is formed from a brightly colored rigid material adapted to provide visual verification of engagement of safety magazine. Concepts described herein are applicable to other locking devices or cases using smart or wireless signaling devices for unlocking.

The following patents are incorporated by reference in their entireties: U.S. Pat. Nos. 6,357,156; 6,412,207; 9,354,011; 9,791,231; and US Publication Nos. 2015/0068088; 2019/0331448; 2019/0093970; and 2018/0128570.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

I claim:

1. A rifle magazine device accessory, the accessory configured for placement in a rifle or gun comprising:

a rectangular housing member having an inner surface, an outer surface, a top opening and a bottom opening, the housing member having an internal plate in contact with the inner surface and having a horizontal orientation parallel to the top opening;

an interlocking mechanism located within the housing member including a center post or plunger member adapted to pass through an aperture of the internal plate and protrude from the top opening of the housing member upon actuation to block a bullet chamber of a rifle or gun, a circular spring member disposed about the center post member and bounded by the internal plate at a distal end of the spring member and at a proximal end of the spring member by a laterally protruding tab on the center post, the circular spring member adapted to provide an expanding force against the protruding tab when the center post protrudes from the top opening; and a base plate coupled to and supporting the center post member in a sliding relationship within the circular spring member and adapted to close the bottom opening, the base plate including a latch pin adapted to engage a retractable latch plate located within the housing member, the latch plate being actuated by a locking mechanism located within the housing below the internal plate.

2. The magazine accessory of claim 1 wherein the latch plate actuated by any one of a solenoid latch plate circuit including a control circuit and a power source adapted to be dislodged with a biometric signal or an RF signal from a smart device; or a combination lock adapted to dislodge the latch plate.

3. The magazine accessory of claim 2 wherein the interlocking mechanism includes at least one interlocking cam located at or near the top opening adapted to engage a portion of the bullet chamber when actuated, the center post further including at least one laterally protruding tab located vertically below the one interlocking cam and adapted to contact and engage the one interlocking cam upon moving the center post member upwards towards the top opening.

4. The magazine accessory of claim 1 wherein the interlocking mechanism includes at least one interlocking cam located at or near the top opening adapted to engage a portion of the bullet chamber when actuated, the center post further including at least one laterally protruding tab located vertically below the one interlocking cam and adapted to contact and engage the one interlocking cam upon moving the center post member upwards towards the top opening.

5. The magazine accessory of claim 4 wherein the interlocking cam includes at least two cantilevering members adapted to open and extend laterally out from the top opening upon being actuated by the laterally protruding tab of the center post member, with the cantilevering members adapted to close and fold inwardly into the housing member when the center post member is retracted.

6. The magazine accessory of claim 5 wherein the interlocking mechanism includes a second interlocking cam disposed on a side of the center post and the housing opposite the first interlocking cam.

7. The magazine accessory of claim 4 wherein the interlocking mechanism includes a second interlocking cam disposed on a side of the center post and the housing opposite the first interlocking cam.

8. The magazine accessory of claim 1 wherein the housing is formed from a brightly colored rigid material adapted to provide visual verification of engagement of safety magazine.

9. The magazine accessory of claim 1 wherein the base plate includes a biometric reader integrated therein and electrically coupled to the interlocking mechanism in the housing member.

10. The magazine accessory of claim 1 wherein the control circuit includes an alarm triggered by attempted destruction of the device, the alarm adapted to either produce extremely loud noise or a spray of indelible ink sprayed onto a person attempting to destroy or remove the magazine accessory without authorization.

* * * * *